US005746632A

United States Patent [19]

Theberge

[11] Patent Number: 5,746,632

[45] Date of Patent: May 5, 1998

[54] FLOATATION AID

[76] Inventor: Dawn L. Theberge, 32 Walker St., Lowell, Mass. 01854

[21] Appl. No.: 838,444

[22] Filed: Apr. 7, 1997

Related U.S. Application Data

[63] Continuation-in-part of Ser. No. 651,466, May 23, 1996, abandoned.

[51] Int. Cl.[6] ..... B03C 9/08

[52] U.S. Cl. ..... 441/115; 441/88

[58] Field of Search ..... 441/80, 88, 106, 441/114–120, 129; 2/67; D2/731, 732

[56] References Cited

U.S. PATENT DOCUMENTS

| | | | |
|---|---|---|---|
| 155,877 | 12/1874 | DeCrenza | D3/17 |
| 245,881 | 9/1881 | Siddons | D2/40 |
| 293,960 | 2/1884 | Berenson | D2/40 |
| 333,903 | 3/1886 | Meredith | D2/4 |
| 679,502 | 7/1901 | Graham . | |
| 715,938 | 12/1902 | Armstrong | 441/117 |
| 728,745 | 5/1903 | Morrison . | |
| 1,252,842 | 1/1918 | Richardson . | |
| 1,273,687 | 7/1918 | Stebbing . | |
| 1,297,270 | 3/1919 | Stebbing . | |
| 1,500,665 | 7/1924 | Blankenhagen . | |
| 1,508,274 | 9/1924 | Mattia | 441/114 |
| 1,647,677 | 11/1927 | Weeks . | |
| 1,932,708 | 10/1933 | Phillips, Jr. | 441/113 |
| 3,015,115 | 1/1962 | Medin | 441/115 |
| 4,276,670 | 7/1981 | Marchello et al. | 9/337 |
| 4,551,107 | 11/1985 | Scheurer et al. | 441/112 |
| 4,619,622 | 10/1986 | McDonald et al. | 441/111 |
| 5,152,706 | 10/1992 | Fister | 441/106 |
| 5,184,968 | 2/1993 | Michalochick et al. | 441/116 |
| 5,342,232 | 8/1994 | Bardot | 441/115 |
| 5,459,874 | 10/1995 | Meredith | 2/67 |

FOREIGN PATENT DOCUMENTS

| | | |
|---|---|---|
| 139582 | 3/1920 | United Kingdom . |

*Primary Examiner*—Ed L. Swinehart

*Attorney, Agent, or Firm*—Weingarten, Schurgin, Gagnebin & Hayes LLP

[57] ABSTRACT

A floatation aid is provided which is especially useful for swimming instruction and which includes a harness and two floatation devices. In an exemplary embodiment the floatation devices are positioned over the chest and the lower back of a person. The floatation aid can support a person's body in a horizontal position while in the water, without impeding movement of the person's limbs or torso. The floatation aid can include adjustable fasteners and pockets to allow for addition and removal of multiple buoyant pads to obtain a desired level of floatation.

16 Claims, 4 Drawing Sheets

FLOATATION AID

RELATED APPLICATION

This application is a file wrapper continuation-in-part, under 37 CFR 1.62, of U.S. Pat. application Ser. No. 08/651,466, filed May 23, 1996, entitled: FLOATATION AID, now abandoned.

FIELD OF THE INVENTION

This invention relates to floatation apparatus and more particularly to swimming and floatation aids.

BACKGROUND OF THE INVENTION

An important aspect of learning to swim is learning to kick properly. Children and beginners often have difficulty learning to kick while swimming, due to the focus of keeping their heads above water. Also handicapped, injured, or elderly people cannot enjoy or partake in water activities due to loss of strength or mobility in their arms and upper body.

Most floatation aids are of the life-jacket type construction and are usually bulky with padding around the neck and chest area of a person. The primary purpose of these floatation aids are to keep a person's head above water. They accomplish this task by keeping the body substantially vertical in the water so that a person's face does not submerge under the water. These floatation aids are not conducive to swimming. They typically obstruct and hamper normal swimming movement of the arms and upper body. These floatation aids are also not comfortable for a relaxing float in the water. Other floatation aids wrap a person's torso in pads and belts, and some use a padded crotch strap, all of which are cumbersome to a swimmer. The floatation aids of the prior art obstruct proper swimming movements, and often do not maintain the body in proper horizontal swimming orientation.

It would therefore be desirable to provide a floatation aid that supports a person's body in a horizontal position while in the water, allowing the person to learn to kick and then swim correctly. It would also be desirable to provide a floatation aid that is comfortable and would allow a person to float in a body of water without any impediments to movement of limbs and torso.

SUMMARY OF THE INVENTION

The present invention overcomes the above disadvantages by providing a floatation aid that supports a user horizontally in a body of water, while not impeding the user's movement of limbs and torso. The floatation aid allows a user to learn proper leg and arm movements for swimming without sinking, and without obstruction to movement. The floatation aid is simple in configuration and easily worn and utilized. It functions equally well as a swimming aid with a user face down in the water and as a leisure or therapeutic aid with a user face up in the water.

In an exemplary embodiment, a floatation aid according to the invention includes a harness having a first end, a second end, and a central region. A first and a second floatation device have first ends proximate the central region of the harness and second ends extending from the central region of the harness to the first end and second end of the harness, respectively. The floatation devices and typically buoyant pads on floats of a suitable foam material. Alternatively the floatation device can be air or gas filled chambers.

Additional features of the present invention include: adjustable fasteners for proper fit; and pockets or channels for multiple buoyant pads to be added or removed for adjustment of desired buoyancy. The present invention can also be configured as a custom fitted bathing suit, or as straps or webbing to be worn over a bathing suit, or a combination of each.

BRIEF DESCRIPTION OF THE DRAWINGS

The invention will be more fully understood by reference to the following detailed description when considered in conjunction with the accompanying drawings, in which.

DETAILED DESCRIPTION OF THE INVENTION

Figure 1:
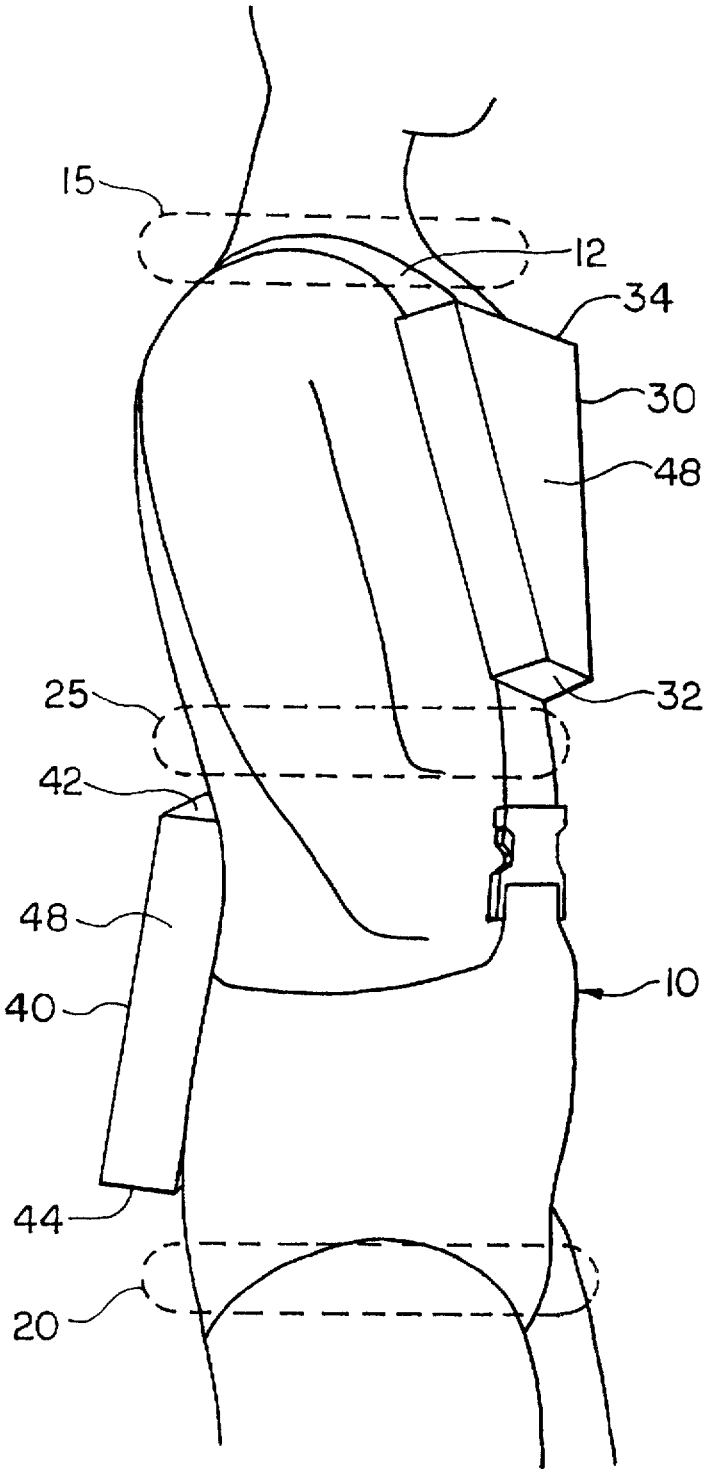
FIG. 1 is a side view of an embodiment of a floatation aid of the invention shown on the torso of a user.

FIG. 1 illustrates a side view of the floatation aid 10. The floatation aid 10 includes a harness 12 having a first or upper end 15, a second or lower end 20, and a central region 25. The central region 25 is proximate the midpoint of the harness 12. When the harness 12 is worn by a user, the first end 15 and second end 20 are proximate the upper chest and crotch areas, respectively, of a user, and the central region 25 is typically proximate the bottom ribs of the user.

The harness 12 can be constructed of any fabric or combination of fabrics suitable to be worn on a human torso, such as nylon, spandex, or mesh. The harness 12 can be composed of strapping or webbing to be worn over a bathing suit, minimally covering a user's body, such as panties and shoulder straps or the harness 12 can be a full garment, such as a bathing suit. The first end 15 and the second end 20 of the harness 12 extend from a user's neck, shoulder and chest area to a user's hipbone and crotch area.

Figure 4:
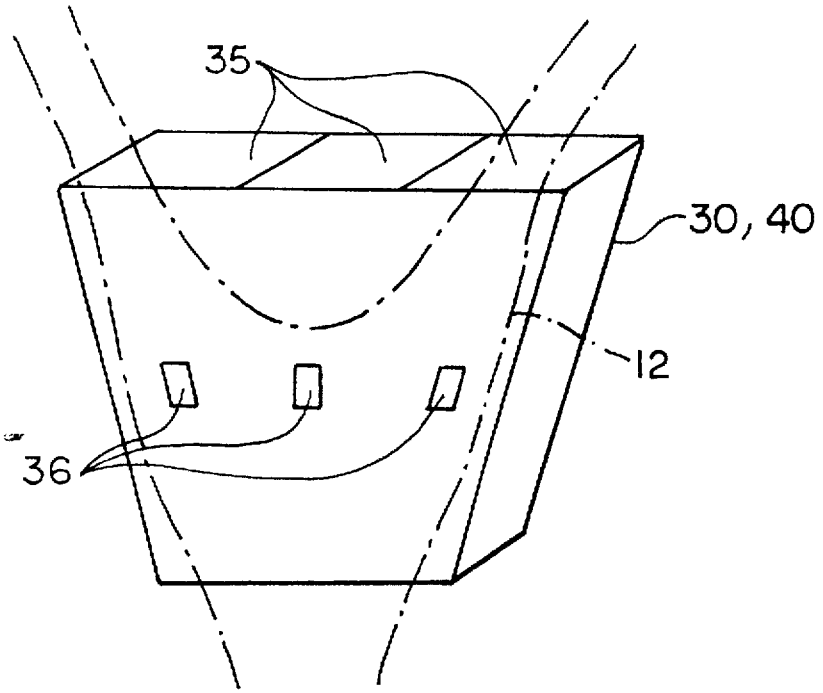
FIG. 4 is a detailed view of an embodiment of a floatation device and harness of the invention with a see-through view of the harness.

The floatation aid illustrated in FIG. 1 also includes a first floatation device 30 having a first end 32 and a second end 34, and a second floatation device 40 having a first end 42 and a second end 44. Both floatation devices 30 & 40 are secured to the harness 12. For example, as shown in FIG. 4, the floatation devices 30 & 40 can be removably secured to the harness 12 in pouches, pockets or channels 35 attached to the harness 12, or by VELCRO® type fasteners 36 or the floatation devices can be permanently attached to the harness 12. Any type of pocket or channel, or other fastening means known in the art for securing floatation devices can be used. Each floatation device 30 & 40 includes at least one buoyant pad 48 which is permanently attached, attached by a VELCRO® type fastener 36, or within a pocket or channel 35. One large buoyant pad can be utilized or multiple smaller pads can be used to obtain a desired amount of buoyancy. When multiple pads 48 are used, the user can remove or add pads to achieve a suitable level of floatation.

Figure 2:
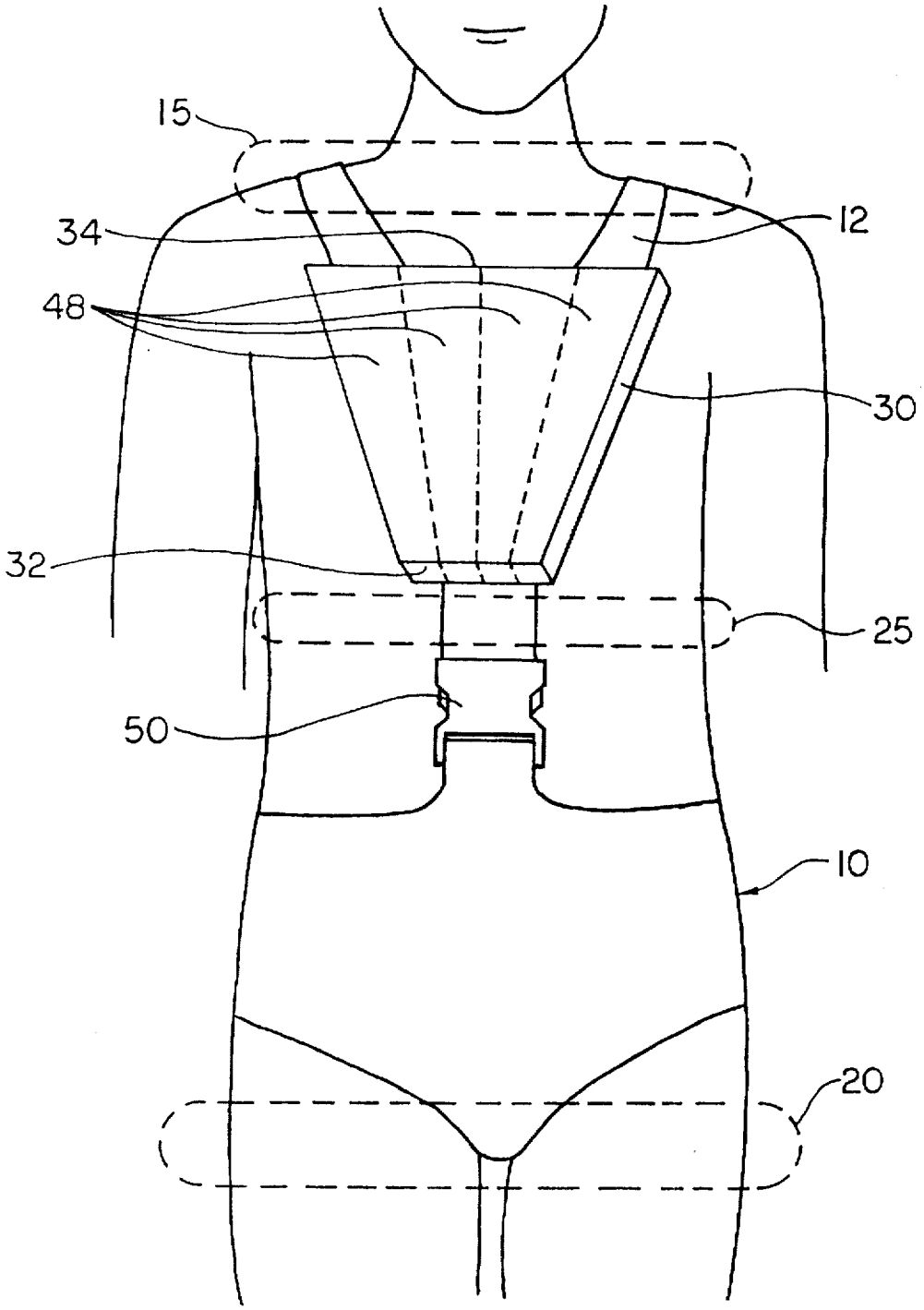
FIG. 2 is a front view of a person wearing the embodiment of the floatation aid shown in FIG. 1.

As shown in FIGS. 1 & 2, the first end 32 of the first floatation device 30 is proximate the central region 25 of the harness 12. The second end 34 of the first floatation device 30 extends from the central region 25 towards the first end 15 of the harness 12. Likewise, the first end 42 of the second floatation device 40 is proximate the central region 25 of the harness 12. The second end 44 of the second floatation device 40 extends from the central region 25 towards the second end 20 of the harness 12.

In an exemplary embodiment the buoyant pads 48 are made of polyuerathane polyethylene or EVA foam. However, the buoyant pads 48 can be made of foamed plastic, or any other buoyant material capable of supporting a user on the surface of a body of water. The buoyant pads 48 can also be inflatable pads, filled with specific gases for a desired level of buoyancy. Furthermore, in an exemplary embodiment the first floatation device 30 is positioned over the chest of a user and the second floatation device 40 is positioned over the lower back of a user, preferably below the last rib and extending downward towards the hipbone of a user. In an alternate embodiment, the first and second floatation devices 30 & 40 can be reversed, with the first floatation device 30 positioned over the abdomen of a user and the second floatation device 40 positioned over the upper back and shoulder area of a user.

In any embodiment of the present invention, the floatation aid 10 supports a user's body in a horizontal position while in the water, and works equally well whether face up or face down in the water. The floatation aid 10 allows a user to learn to kick and swim properly without worry of keeping afloat. Moreover, the floatation aid 10 does not impede any movement of a user's limbs or torso, allowing a user to quickly learn proper leg and arm movements for swimming, without physical distractions, such as sinking or someone holding the user. The floatation aid 10 is also equally suitable for leisure purposes, such as floating in a pool or other body of water, without need for exertion.

Figure 3:
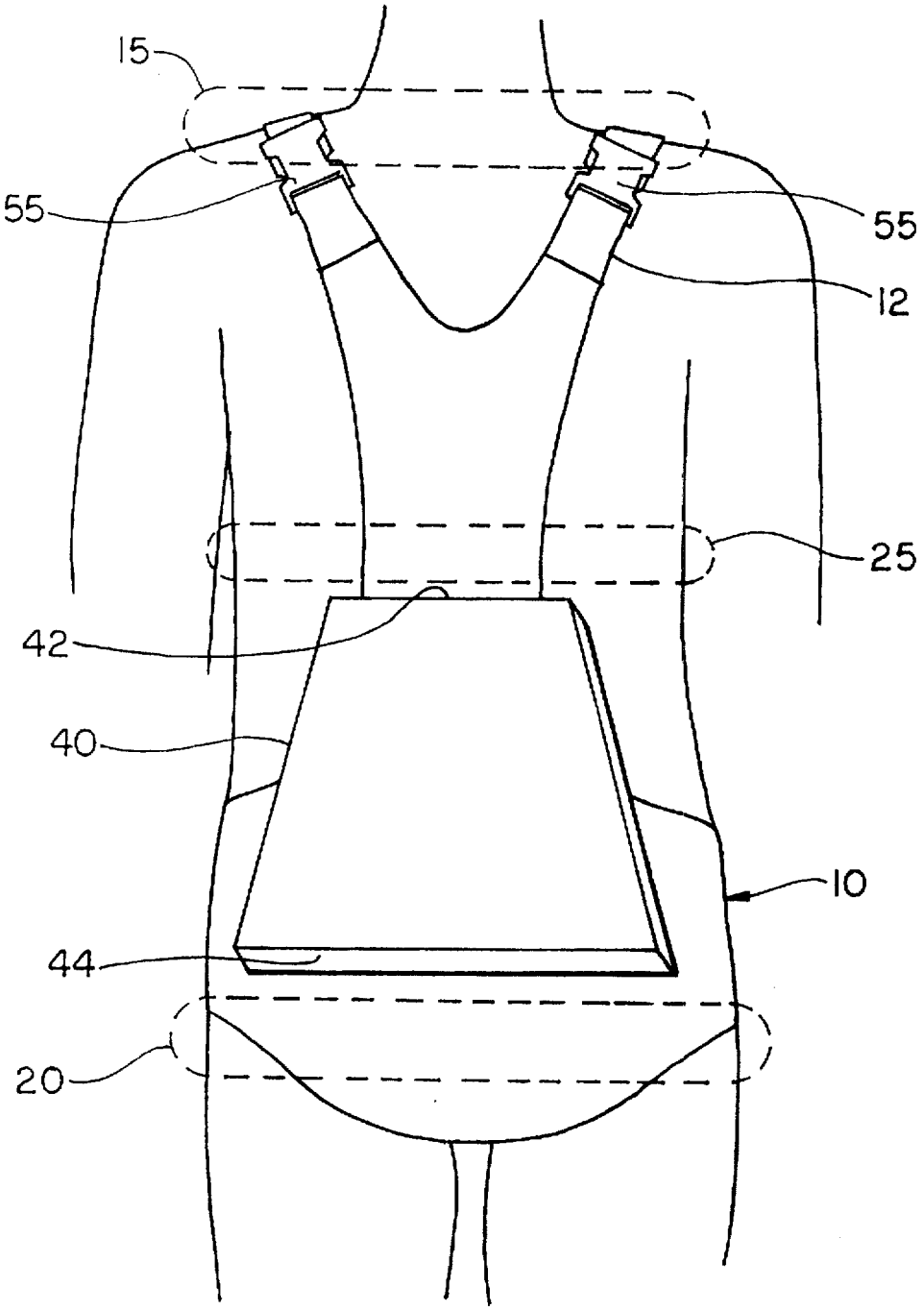
FIG. 3 is a rear view of the embodiment of the floatation aid shown in FIG. 1.

As shown in FIGS. 2 & 3, the first and second floatation devices 30 & 40 are typically trapezoidal in shape, with narrow first ends 32 & 42 and widening as the floatation devices extend toward the second ends 34 & 44. This configuration provides a maximum amount of buoyancy, without impeding a user's swimming motions. However, many other shapes can be utilized, depending on the buoyancy of the material used and the shape of a user, as long as the other shapes do not impede a user's movements.

In other embodiments, as FIGS. 2 & 3 show, the floatation aid 10, can be provided with adjustable front and back fasteners 50 & 55, for a user to obtain a proper fit. The front and back fasteners 50 & 55 can be adjustable straps, buckles, VELCRO® type fasteners, or any type of adjustable fastener known in the art. Front fastener 50 in conjunction with back fasteners 55, allow the harness 12 to be adjusted for different body shapes, while keeping the first and second floatation devices 30 & 40 in proper placement to provide horizontal floatation support to a user's body. The floatation aid 10 can also be custom fitted to a user, so that no fasteners are needed.

The floatation aid 10 is primarily configured as a swimming aid, to allow a user to learn proper movement of the legs and arms while the user's body is supported in a horizontal position while in the water. In other embodiments, the floatation aid 10 can be used for leisure or therapeutic purposes to support a user horizontally in the water face up. The configuration of the floatation aid 10 works equally well face up or face down in the water. The floatation aid 10 can also be adorned in different or multiple colors, cartoons, or any design that would be aesthetically pleasing. Different designs can be placed on the floatation aid 10 to suit diverse users from children to the elderly.

Although the invention has been shown and described with respect to exemplary embodiments thereof, various other changes, omissions and additions and form in detail thereof, may be made therein without departing from the spirit and scope of the invention.

What is claimed is:

1. A floatation aid for horizontal support of a person in a body of water, said floatation aid comprising:

a harness having a first end, a second end, and a central region, said central region proximate a person's lower ribs;

a first floatation device having a first end proximate said central region of said harness, and having a second end extending from said central region of said harness toward said first end of said harness, said first floatation device located only over the frontside of a torso of a person;

a second floatation device having a first end proximate said central region of said harness, and having a second end extending from said central region of said harness toward said second end of said harness, said second floatation device located only over the backside of a torso of a person;

one of said first and second floatation devices positioned only below said central region proximate the person's lower ribs and extending downward towards the person's hipbone, the other of said first and second floatation devices positioned only above said central region and extending upwards towards the person's neck, said first and second floatation devices positioned to floatationally support a person generally in a horizontal position.

2. The floatation aid of claim 1, wherein said first and second floatation devices include at least one removable buoyant pad.

3. The floatation aid of claim 1, wherein said first and second floatation devices further include channels capable of holding multiple removable buoyant pads.

4. The floatation aid of claim 2, wherein said at least one removable buoyant pad is Polyuerathane foam.

5. The floatation aid of claim 2, wherein said at least one removable buoyant pad is EVA foam.

6. The floatation aid of claim 2, wherein said at least one removable buoyant pad is filled with air.

7. The floatation aid of claim 1, wherein said harness further includes adjustable fasteners.

8. The floatation aid of claim 1, wherein said harness is formed of spandex.

9. The floatation aid of claim 1, wherein said first and second floatation devices are removably attached to said harness.

10. The floatation aid of claim 2, wherein said at least one removable buoyant pad is Polyethylene foam.

11. A floatation aid for horizontal support of a person in a body of water, said floatation aid comprising:

a harness having a first end, a second end, and a central region;

a first floatation device having a first end proximate said central region of said harness, and having a second end extending from said central region of said harness toward said first end of said harness, said first floatation device located only over the frontside of a torso of a person;

a second floatation device having a first end proximate said central region of said harness, and having a second end extending from said central region of said harness toward said second end of said harness, said second floatation device located only over the backside of a torso of a person;

said first and second floatation devices positioned to floatationally support a person generally in a horizontal position;

wherein said first and second floatation devices are substantially trapezoidal.

12. A floatation aid for horizontal support of a person in a body of water, said floatation aid comprising:

a harness having a first end, a second end, and a central region;

a first floatation device having a first end proximate said central region of said harness, and having a second end extending from said central region of said harness toward said first end of said harness, said first floatation device located only over the frontside of a torso of a person;

a second floatation device having a first end proximate said central region of said harness, and having a second end extending from said central region of said harness toward said second end of said harness, said second floatation device located only over the backside of a torso of a person;

said first and second floatation devices positioned to floatationally support a person generally in a horizontal position;

wherein said harness is integral with a bathing suit.

13. A floatation aid for horizontal support of a person in a body of water, said floatation aid comprising:

a harness having a first end, a second end, and a central region;

a first floatation device having a first end proximate said central region of said harness, and having a second end extending from said central region of said harness toward said first end of said harness, said first floatation device located only over the frontside of a torso of a person;

a second floatation device having a first end proximate said central region of said harness, and having a second end extending from said central region of said harness toward said second end of said harness, said second floatation device located only over the backside of a torso of a person;

said first and second floatation devices positioned to floatationally support a person generally in a horizontal position;

wherein said harness is integral with panties and shoulder straps.

14. A floatation aid for horizontal support of a person in a body of water, said floatation aid comprising:

a fabric including a plurality of fasteners, at least some of said fasteners being adjustable to allow said fabric to fit a person's torso; and a first floatation device and a second floatation device attached to said fabric, each floatation device including at least one buoyant pad, said first floatation device positioned only over the front portion of a user's torso, said second floatation device positioned only over the back portion of the user's torso, one of said first and second floatation devices positioned only below the user's lower ribs and extending downwards towards the user's hipbone;

said first and second floatation devices approximately positioned from a midpoint of said fabric proximate the user's lower ribs and extending in opposite directions to opposite ends of said fabric, said first and second floatation devices positioned to floatationally support the user's torso generally in a horizontal position in a body of water.

15. The floatation aid of claim 13, wherein said first floatation device is positioned over a user's chest.

16. The floatation aid of claim 13, wherein said second floatation device is positioned below the user's bottom rib and extends downward.

* * * * *